United States Patent [19]

Roca-Nierga

[11] Patent Number: 4,461,259

[45] Date of Patent: Jul. 24, 1984

[54] DISTRIBUTOR TYPE INJECTION PUMP FOR FEEDING FUEL TO AN INTERNAL COMBUSTION ENGINE

[75] Inventor: Manuel Roca-Nierga, Barcelona, Spain

[73] Assignee: SPICA S.p.A., Leghorn, Italy

[21] Appl. No.: 549,013

[22] Filed: Nov. 4, 1983

Related U.S. Application Data

[63] Continuation of Ser. No. 328,805, Dec. 9, 1981, abandoned.

[30] Foreign Application Priority Data

Dec. 29, 1980 [DE] Fed. Rep. of Germany ..... 3049367

[51] Int. Cl.[3] ..... F02M 41/00

[52] U.S. Cl. ..... 123/449; 123/506; 417/289

[58] Field of Search ..... 123/449, 450, 451, 448, 123/503, 506; 417/289, 294, 282

[56] References Cited

U.S. PATENT DOCUMENTS

| | | | |
|---|---|---|---|
| 3,777,731 | 12/1973 | Kobayashi et al. | 123/449 |
| 3,910,724 | 10/1975 | Okamoto | 123/449 |
| 4,073,275 | 2/1978 | Hofer et al. | 123/449 |
| 4,284,047 | 8/1981 | Stumpp | 123/449 |

FOREIGN PATENT DOCUMENTS

| | | | |
|---|---|---|---|
| 819858 | 9/1959 | United Kingdom | 123/449 |

OTHER PUBLICATIONS

Straubel et al., Distributor Injection Pump, Aug. 1, 1979.

*Primary Examiner*—Ira S. Lazarus
*Assistant Examiner*—Magdalen Moy
*Attorney, Agent, or Firm*—Diller, Ramik & Wight

[57] ABSTRACT

The invention relates to an injection pump of the piston-distributor type which is mobile with reciprocating and axial rotary motion, and comprises a discharge chamber.

Said chamber is maintained at a pressure substantially less than the feed pressure in order to determine rapid stoppage of the engine at the instant of closure of a solenoid valve.

1 Claim, 1 Drawing Figure

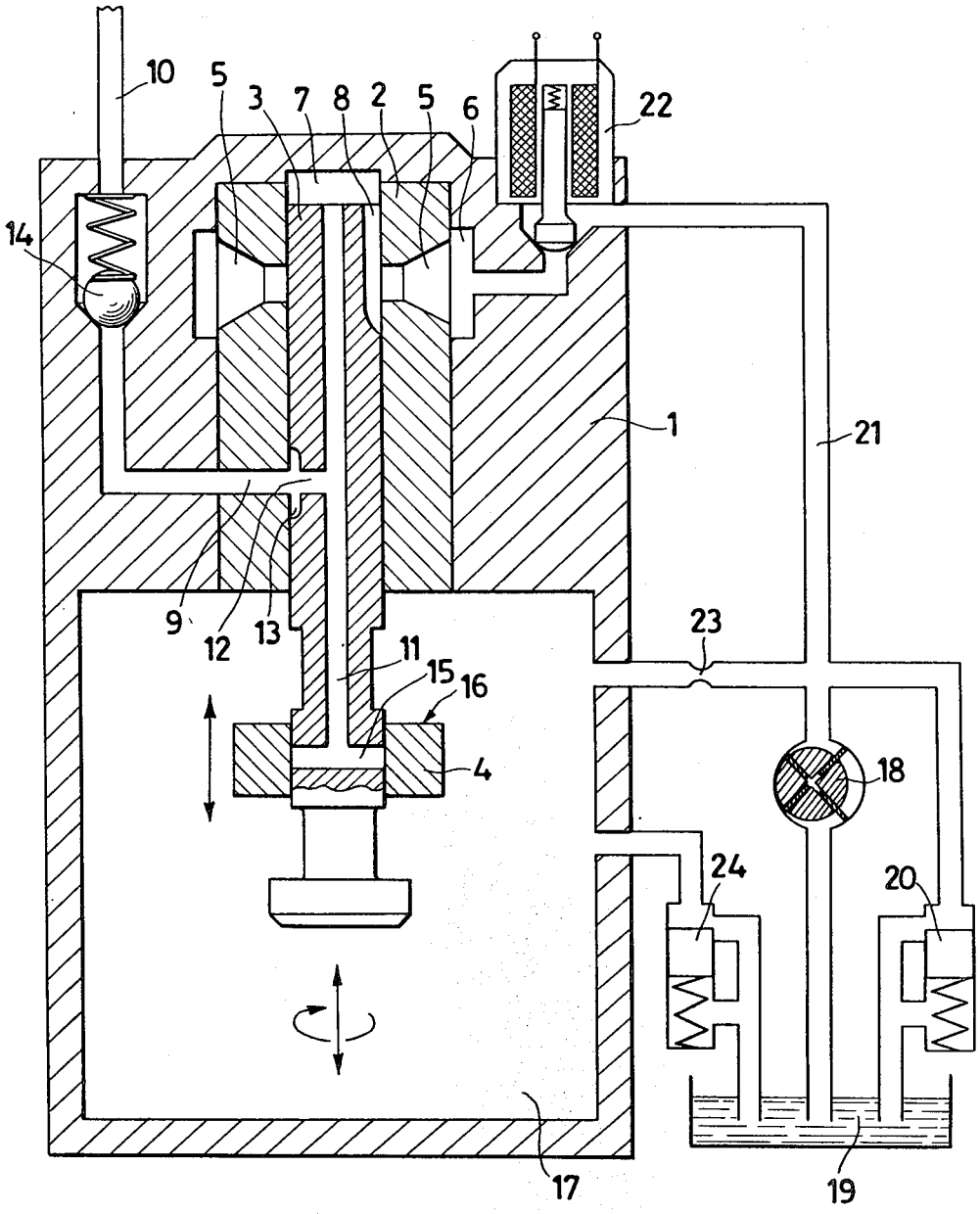
10
5
3
7
8
2
5
6
22
14
1
21
9
12
13
11
15
16
23
4
18
24
20
17
19

DISTRIBUTOR TYPE INJECTION PUMP FOR FEEDING FUEL TO AN INTERNAL COMBUSTION ENGINE

This application is a continuation, of application Ser. No. 328,805, filed Dec. 9, 1981, now abandoned.

This invention relates to an injection pump of the type in which a pumping piston is driven with reciprocating pumping motion, together with axial rotary motion to perform the function of a distributor.

This latter function is performed by one or more cavities disposed peripherally on the piston and which become disposed in positions corresponding with suction ports and delivery ports leading to the various nozzles of each engine cylinder, in order to put said ports into communication with the pumping chamber in suitable phase with the axial movement of the piston.

The pumping chamber is also put into communication with a duct which extends longitudinally in the piston and opens radially into a portion of the rod of said piston which slides in a mobile ring, this latter uncovering the end of said duct at a position in the piston stroke which varies as the position of the ring varies. In this manner, the compression chamber is discharged after the piston has carried out a determinable active pumping stroke, which determines the delivery rate of the pump.

That end of the piston rod on which known means act for transmitting to it the reciprocating and rotary movements is contained in a chamber in which the said duct uncovered by the adjustable position ring opens.

In general, in the conventional injection pump structure, this chamber is fed by a branch from the delivery side of the feed pump, and is thus at the same pressure as exists on the suction side of the injection pump.

The object of the invention is to allow rapid interruption of the delivery flow from the injection pump when immediate stoppage of the engine fed by it is required.

This object is attained according to the invention by an injection pump in which a piston-distributor moves with reciprocating and rotary motion in a pumping chamber, and of which the rod projects into a lower chamber and is provided with radial bores cooperating with an annular element which by its axial movement determines the piston position in which said bores are uncovered, and a feed pump of which the delivery side feeds the suction side of the injection pump by way of a solenoid shut-off valve, said delivery side being connected to discharge through a pressure relief valve, characterised in that said lower chamber is connected to said delivery side and is provided with means for controlling the fuel feed and discharge to and from said chamber in order to maintain it at a pressure lower than that existing in the feed circuit of the injection pump.

The structural and operational characteristics of the invention and its advantages compared with the prior art will be more apparent from an examination of the description given hereinafter by way of example with reference to the accompanying drawing, in which the single FIGURE is a section through an injection pump in accordance with one embodiment of the invention.

With reference to the drawing, the casing 1 shown in diagrammatic elementary form, of an injection pump contains a hydraulic head comprising the cylinder 2, piston 3 and regulator ring 4. Various feed ducts 5 are provided in the cylinder to connect an annular feed chamber 6, which can be provided in the pump casing (as in the FIGURE) or in the periphery of the cylinder, to the inner cylindrical bore of the pumping element.

One or more feed cavities 8 are provided in the end portion of the cylindrical surface of the piston 3 adjacent to the pressure chamber 7, and connect the feed bores 5 to said pressure chamber during the piston intake stage in order to fill the chamber.

The piston 3 is driven with alternating and rotary motion by known mechanisms, not shown, to determine the intake, pumping and distribution of the fuel in phase with the uncovering, or otherwise, of the feed ducts 5 and delivery ducts 9 which connect the hydraulic head to the injection pipes 10.

The commencement of delivery takes place when, during the compression stroke of the piston 3, the rotary movement of the piston causes interruption of the connection between the cavity or cavities 8 and the ducts 5.

The fuel compressed in the pressure chamber 7 is distributed to the various delivery ducts 9 by way of the central bore 11 inside the piston 3, the transverse bore 12 and the distribution cavity 13.

The control valve 14 is connected between the delivery ducts 9 and the injection pipes 10 associated with the various engine cylinders.

The end of delivery takes place when, during the compression stroke of the piston 3, the upper edge of the transverse bore 15 connected to the central bore 11 becomes uncovered by the cooperating wall 16 of the regulator ring 4, so enabling the excess fuel to flow back to the discharge chamber 17. The axial position of the ring 4, which is governed by a regulator of known type, thus determines the quantity of fuel injected into the various internal combustion engine cylinders by the respective injector units (not shown in the FIGURE).

A feed pump 18 feeds fuel to the injection pump by withdrawing it from the tank 19. The feed pressure is determined by the setting of the return flow valve 20.

A solenoid valve 22 housed in the pump casing is connected between the feed pipe 21 and chamber 6, in order to interrupt the fuel flow to the hydraulic head when it is required to stop the internal combustion engine.

As said solenoid valve is of the normally closed type, fuel feed to the chamber 6 is allowed only when electrical voltage is present across the valve solenoid. For this reason, the solenoid valve 22 is usually connected to the switch on the vehicle electric panel.

In order to accelerate emptying of the feed chamber 6 and the ducts connected thereto after operating the electrical stop control, and thus minimise any delay in the effective stopping of the engine, the pressure in the discharge chamber 17 is maintained at a value substantially lower than the feed pressure by means of the flow constriction 23 and the discharge valve 24.

The residual pressure in the feed ducts downstream of the solenoid valve is balanced with the pressure in the discharge chamber during that portion of the stroke of the piston 3 which comprises the uncovering of the upper edge of the transverse bore 15 by the cooperating surface 16 of the regulator ring 4.

The fuel contained in the discharge chamber 11 also serves as a lubricant for the mechanical units (not shown in the FIGURE) housed in said chamber.

In this manner the object of the present invention is therefore attained, namely to allow rapid emptying of the feed ducts located between the pressure chamber 7 and said solenoid valve on closing the solenoid valve 22, in order to minimise the time which passes between the operation of the electrical stop control for the engine and the effective stoppage of this latter.

For this purpose, the pump according to the invention uses means (valves, constrictions etc.) suitable for maintaining in the discharge chamber 17 a pressure which is substantially different and less than that existing in the feed circuit of the hydraulic head.

It should also be noted on the basis of the described embodiment of the invention, that the said injection pump comprises zones which operate at three different fluid pressures:

(1) High pressure (injection pressure)
(2) Medium pressure (feed pressure)
(3) Low pressure (discharge pressure and lubrication pressure for the mechanical units).

In contrast, single piston distributor pumps of known type use for the operating section only two fluid pressures, the discharge pressure being equal to the feed pressure.

Consequently, said pumps lack the function performed by the low pressure discharge chamber of the present invention.

I claim:

1. An injection pump for feeding fuel to an internal combustion engine comprising a housing, a pumping chamber within said housing, a piston-distributor mounted for reciprocal and rotary motion within said pumping chamber, said piston-distributor including an end portion disposed in a discharge chamber of said housing, first duct means for delivering excess fuel from said pumping chamber into said discharge chamber when a bore of said first duct means is placed in fluid communication with said discharge chamber, means for regulating the closing of said bore, second duct means for delivering pressurized fuel from said pumping chamber to an internal combustion engine, a feed pump for delivering fuel from a fuel source through third duct means into said pumping chamber, solenoid valve means for controlling fuel flow between first and second portions of said third duct means, said third duct means first portion being disposed upstream of said solenoid valve means and said third duct means second portion being disposed downstream of said solenoid valve means, said third duct means second portion being in free fluid communication with said discharge chamber through said first duct means even when said solenoid valve means closes fluid communication between said third duct means first and second portions, fourth duct means between said third duct means first portion and said discharge chamber for placing the same in fluid communication with each other, means for constricting fuel flow through said fourth duct means to thereby maintain a pressure differential between said discharge chamber and said third duct means first portion, first regulator valve means between said fuel source and said third duct means first portion for regulating pressure in said third duct means in response to engine speed, and second regulator valve means between said fuel source and said discharge chamber for regulating pressure in said discharge chamber at all times lower than the pressure in said third duct means.

* * * * *